US005305564A

United States Patent [19]

Fahey

[11] Patent Number: 5,305,564

[45] Date of Patent: Apr. 26, 1994

[54] HEMISPHERICAL DOME BUILDING STRUCTURE

[76] Inventor: William E. Fahey, 472 Spaulding, Akron, Ohio 44310

[21] Appl. No.: 874,604

[22] Filed: Apr. 27, 1992

[51] Int. Cl.[5] ..... E04B 1/32

[52] U.S. Cl. ..... 52/81.5; 52/80.1; 52/597; 52/598; 52/604; 52/606; 52/608

[58] Field of Search ..... 52/80.1, 81.1, 81.4, 52/81.5, 89, 575, 604, DIG. 10, 606, 608, 609, 597, 598

[56] References Cited

U.S. PATENT DOCUMENTS 2,682,235 12/1951 Fuller .
3,171,370 3/1965 Fay ..... 52/89
3,359,694 8/1965 Hein .
3,485,000 12/1967 Fiquet .
3,691,704 9/1972 Novak .
3,788,015 1/1974 Musser ..... 52/81.1
3,898,777 8/1975 Georgiev et al. ..... 52/81.1
3,955,329 5/1976 Hannula .
4,715,160 12/1987 Romanelli .

*Primary Examiner*—Michael Safavi
*Attorney, Agent, or Firm*—Oldham, Oldham & Wilson Co.

[57] ABSTRACT

Hemispherical dome comprising a plurality of rigid longitudinally extending and radially oriented cells of like size and shape, and arranged in a plurality of circular rows. Each cell is essentially frustopyramidal in shape, having a polygonal cross-sectional shape and tapering slightly in the longitudinal direction from one end to the other. The longitudinal edges of each cell lie along radii of the hemisphere. Each cell is a hollow structure, having side wall means which completely surround an interior air space and which include spaced apart top and bottom walls. It can be formed of a lightweight material, preferably a plastic and especially polycarbonate. The hemispherical dome of this invention provides a lightweight, strong and energy efficient structure which does not require internal supports.

12 Claims, 5 Drawing Sheets

HEMISPHERICAL DOME BUILDING STRUCTURE

TECHNICAL FIELD

This invention relates to building structures in the shape of a hemispherical dome and more particularly to a hemispherical dome building structure which is formed from a plurality of unit cells of like size and shape.

BACKGROUND ART

Structures in the shape of a hollow hemispherical dome have been proposed and a few such structures have been built. One such recognized name in this art is that of R. Buckminster Fuller. Fuller is the holder of U.S. Pat. No. 2,682,235. U.S. Pat. No. 2,682,235 shows a building structure of generally spherical shape and comprising a framework of interconnected struts arranged in the pattern of a spherical icosahedron. Struts of various lengths are required.

U.S. Pat. No. 3,359,694 to Hein shows a building structure in the shape of a dome of generally hemispherical shape and comprising a plurality of panels of different shapes which form the exterior wall of the dome.

U.S. Pat. No. 3,995,329 to Hannula also shows a building structure in the shape of a hollow dome which may be hemispherical. The dome wall is formed of a plurality of structural cells most of which are square (some are in the shape of an isosceles triangle) and thin in the radial direction of the sphere. The cells are arranged in horizontal rows. A problem with the structure shown in this patent is that the size of the cells must decrease to correspond to the diminishing circumferences of the individual horizontal rows as one goes away from the equator toward the top of the sphere. (The same is true as one goes away from the equator downwardly in those situations where a given dome comprises more than one-half of a sphere).

Other domed building structures are shown in U.S. Pat. No. 3,485,000 to Fiquet, and U.S. Pat. No. 3,691,704 to Novak. U.S. Pat. No. 4,715,160 to Romanelli shows a set of standardized structural elements and accessories which may be used to erect either a "spatial" or a flat structure.

The hemispherical dome building structure appears to have become more an object of fascination than of practical realization. Relatively few such structures have been built. It is believed that the inherent disadvantages of the hollow generally spherical dome structures known to date has been a major reason for this. For instance, the structure of the Hannula patent cited above requires cells of different sizes, which is a major complication in a building structure that is assembled on site.

SUMMARY OF THE INVENTION

This invention provides a hollow generally spherical building structure, or hemispherical dome, comprising a plurality of rigid radially extending unit cells of like size and shape. These unit cells are arranged in horizontal rows and each cell is radially oriented, so that the longitudinal direction of each cell is in a radial direction of the hemisphere. A unit cell is of essentially frustopyramidal shape, having two spaced apart ends and longitudinal edges which extend from end to the other. The two ends or end faces of the prism are preferably open. Each end has a perimeter in the shape of a closed curve, preferably a polygon and most preferably an isosceles trapezoid. The sides of each cell are preferably formed by side walls of rigid material. These side walls extend from one end of the cell to the other end. The longitudinal edges of the preferred cell are formed by the intersections of adjacent sides.

A unit cell has the same cross-sectional shape along its entire length, but is slightly larger at one end than the other. The larger end of each unit cell is disposed along the outer circumference of the sphere and the smaller end forms the inside wall of the hemisphere. The preferred unit cell has a cross-sectional shape of an isosceles trapezoid and generally resembles a hollow truncated triangular prism in appearance. Such preferred unit cell has four longitudinal edges at the intersections of adjacent sides. All four longitudinal edges of the unit cell are aligned along radii of the hemisphere so that they converge slightly going from the larger end to the smaller end of the cell. Consequently, the angular height and the angular width of a unit cell (measured in spherical coordinates) are each the same at both ends, while the linear height and the linear width (measured in rectangular coordinates) are each slightly greater at one end than at the other.

DETAILED DESCRIPTION

This invention will now be described in detail with reference to specific embodiments including the best mode and preferred embodiment.

Figure 1:
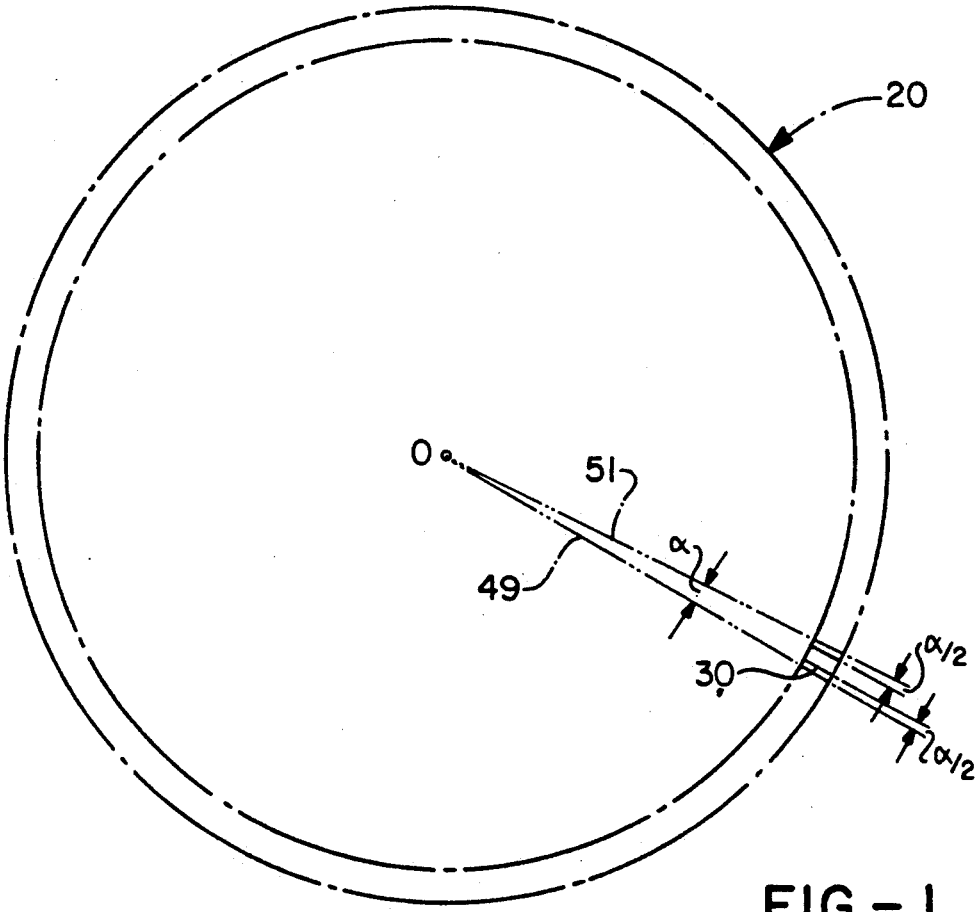
FIG. 1 is a diagrammatic top plan view of a hemispherical dome according to this invention.
Figure 2:
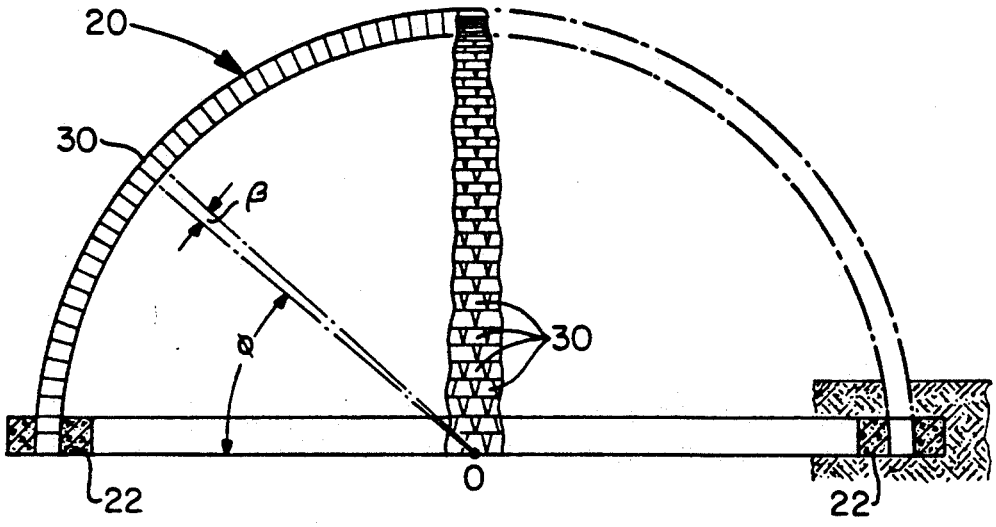
FIG. 2 is a front elevation view of a hemispherical dome according to this invention with parts broken away.

Referring now to FIGS. 1 and 2, 20 is a hollow hemispherical dome according to this invention. As may be seen particularly in FIG. 2, hemispherical dome 20 is a hollow structure having an exterior wall formed by a plurality of radially extending unit cells 30 of like size and shape and arranged in a plurality of horizontal rows. The longitudinal direction of each cell 30 is the radial direction of the dome 20. Each row of cells is circular, extending around the entire hemisphere. The bottoms of the lowest or base row of cells 30 lie in a common plane, which is the equatorial plane of the hemisphere. Assuming that the equatorial plane is level, which is usually the case, the elevation of each horizontal row of cells is constant and can be measured either in feet above the equatorial plane or (as is often more convenient) in angular measure, wherein the "latitude" or angle of elevation above the equatorial plane may be denoted by $\phi$ (phi), which may range from 0° (the base row) to just slightly less than 90°.

The first few rows (say the first four rows) of the dome 20 are preferably erected below ground level and filled with dry sand in bags to provide stability and resistance to wind lift. It is necessary to provide a concrete foundation or slab. FIG. 2 shows a ring shaped poured concrete foundation 22 on which the lowermost portion of dome 20 is embedded. The annular width of foundation 22 is preferably the same as the length of a cell to be hereinafter described. The lowermost or base row of cells 30 has a larger number of cells than any higher row. Thus, for example, the lowermost or base row may have 480 cells, each having a uniform angular width $\alpha$ of $\frac{3}{4}$° (45 minutes). The number of cells in a row diminishes regularly with increasing height above the base; until the topmost row (near but not precisely at the top of dome 20) may have only 6 cells. (Neither the number of cells in the base row nor the number in the topmost row is critical)

The hemispherical dome 20 of this invention is a hollow self-supporting building structure. It is useful as an auditorium, sports arena, gymnastic or exercise structure, greenhouse, barn, silo, storage unit, theater, or air plane hanger, for example. Other uses will be apparent. Dome 20 may be of any desired size. The size of the structure depends on its intended use. The diameter may range, for example, from as little as 40 feet (or even less) up to about 250 or even 300 feet or greater. The maximum diameter is limited only by considerations of practicality in building a large structure. The height of the structure is equal to the radius and is therefore one half the diameter.

Figure 3:
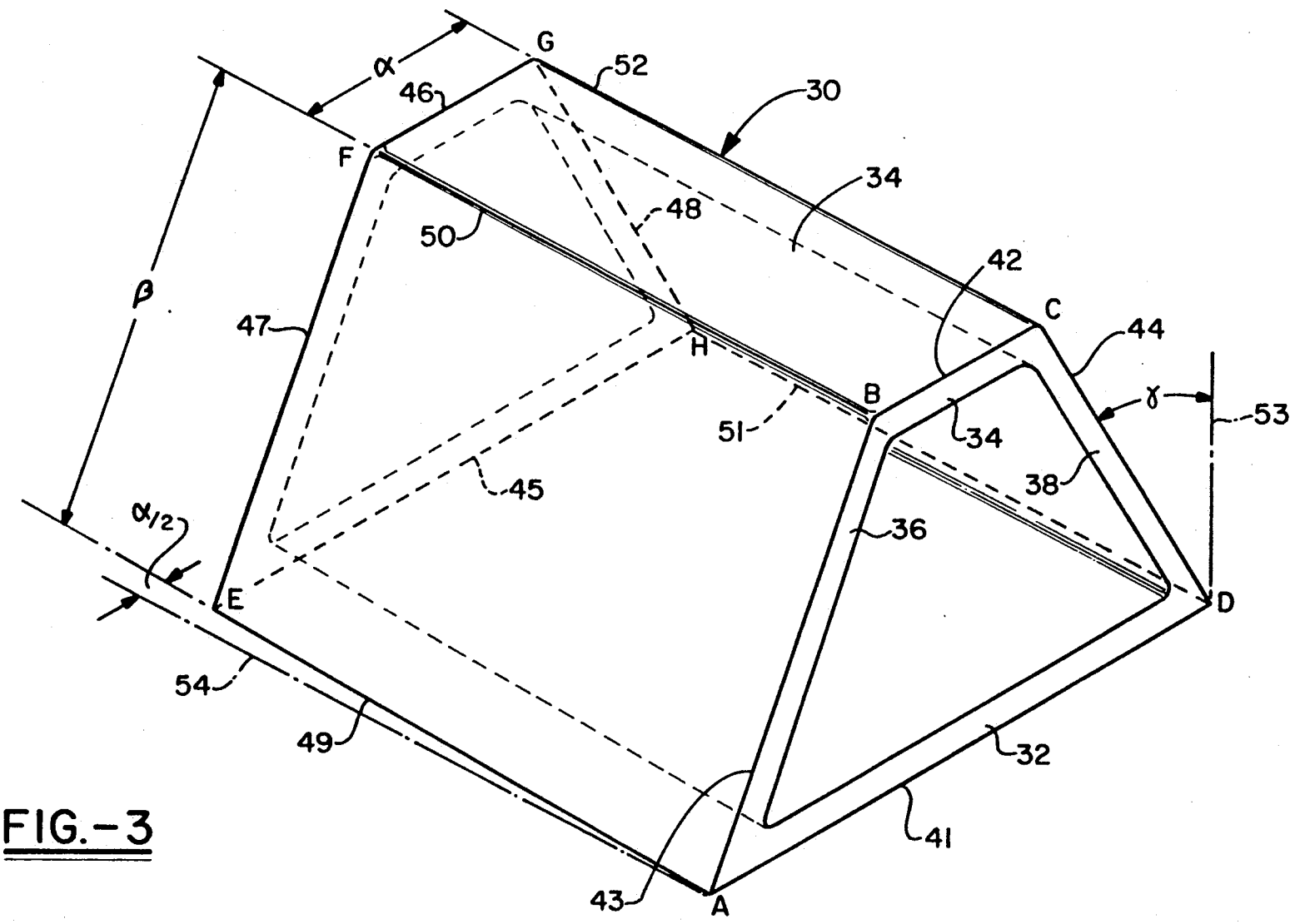
FIG. 3 is a detailed perspective view of a unit cell according to this invention.
Figure 5:
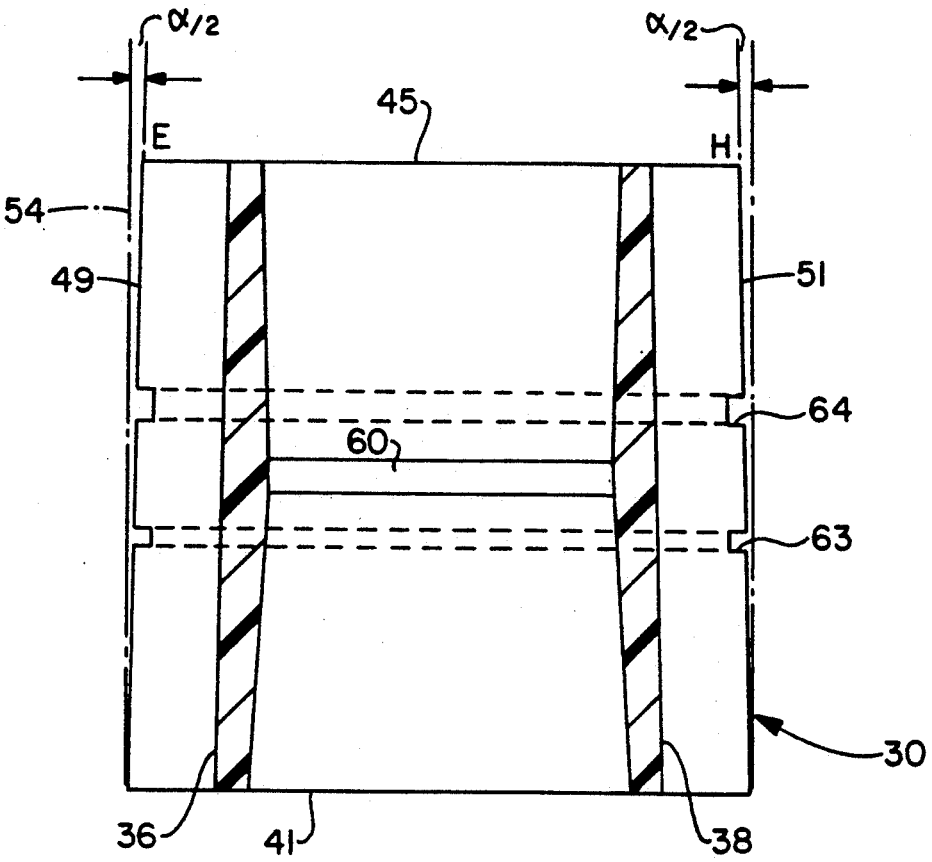
FIG. 5 is a horizontal sectional view taken along line 5—5 of FIG. 4.
Figure 4:
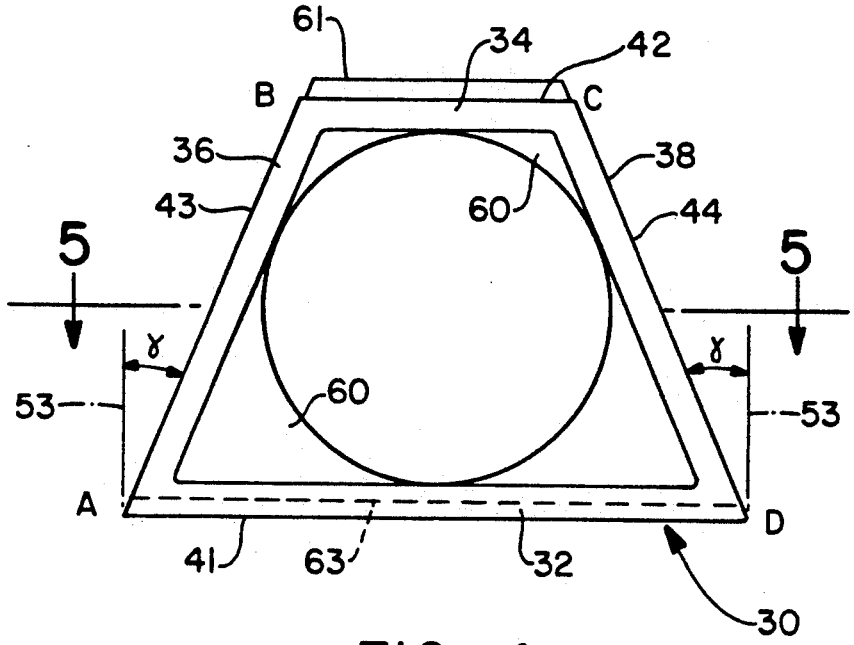
FIG. 4 is a front elevation view of a unit cell according to this invention.

A preferred unit cell 30, with the outer end simplified for purpose of illustration, is shown in FIGS. 3-5.

Each unit cell 30 is a hollow body which is essentially prismatic in shape. Each cell extends longitudinally and is of polygonal cross-sectional shape as is characteristic of a prism. However, a unit cell of this invention differs from a true prism in that the unit cell 30 herein is slightly larger at one end than at the other end. A unit cell of this invention tapers from the larger end to the smaller end and the longitudinally extending edges of the cell, instead of being parallel as in a prism, are disposed along radii of hemisphere 20. This is shown in FIGS. 1 and 2 and will be discussed in further detail with reference to FIGS. 3 and 14. The shape of a unit cell 30 may be more precisely described as being essentially frustopyramidal.

Each cell 30 tapers uniformly from the larger end to the smaller end. The angular width $\alpha$ (alpha) is uniform over the entire length of the cell and is typically from about 0.667° (40 minutes) to about 1°. The angular height $\beta$ (beta) is preferably 0.5° (30 minutes) but may be from about 0.333° (20 minutes) to about 0.75° (45 minutes). The angular height of a cell is not greater than the angular width and is preferably less. The ratio of angular width to angular height is typically from about 4:3 (1.33:1) to about 2:1, and a particularly preferred ratio is about 3:2 (1.5:1).

FIG. 3 is a perspective view of a preferred unit cell 30, as seen from the larger or front end. This preferred unit cell 30 is essentially in the shape of a truncated triangular prism (or more precisely, a quadrilateral prism) having a cross-sectional shape of a isosceles trapezoid. The unit cell may be formed of a rigid or semi-rigid molded plastic, e.g., polycarbonate, and may be transparent. Cell 30 is hollow and is preferably open at both ends. Cell 30 comprises a bottom wall 32 and a top wall 34 which is spaced from the bottom wall 32 so that there is an open interior or air space therebetween. Top wall 34 is nearly but not quite parallel to bottom wall 32. If the bottom wall is level (as is the case in cells in the base row), the top wall slopes downwardly at an angle $\beta$ from the outer end to the inner end. A unit cell 30 also has a pair of sloping sidewalls 36 and 38 which slope upwardly and inwardly from bottom wall 32 to top wall 34. Thus top wall 34 is appreciably narrower than bottom wall 32, although both have the same length.

The bottom wall 32, top wall 34 and side walls 36 and 38 collectively may be termed "side wall means" or "exterior wall means" and together they completely surround or encircle the cell interior, which for the most part is air space.

The outer end of cell 30 is in the shape of a isosceles trapezoid having corners A, B, C and D. The inner end of cell 30 is also in the shape of an isosceles trapezoid having corners E, F, G and H. The two trapezoids have the same shape but the trapezoid E, F, G, H at the back or inner end of the cell is slightly smaller than the trapezoid A,B,C,D at the outer or front end of the cell. The cross-sectional shape of a cell 30 (which is taken along a transverse plane parallel to the inner and outer ends of the cell) is that of an isosceles trapezoid having the same shape as the two isosceles trapezoids at either end but being of a size intermediate between the sizes of the two end isosceles trapezoids.

Cell 30 has at its outer or larger end a horizontal bottom edge 41, a horizontal top edge 42 and two upwardly and inwardly sloping edges 43 and 44. These edges are, respectively, edges of bottom wall 32, top wall 34, side wall 36 and side wall 38. These edges together form an isosceles trapezoid.

Similarly, unit cell 30 at the inner and smaller end has a horizontal bottom edge 45, a horizontal top edge 46, and upwardly and inwardly sloping side edges 47 and 48. These edges are, respectively, edges of bottom wall 32, top wall 34, side wall 36 and side wall 38. Edges 45, 46, 47 and 48 together define an isosceles trapezoid of the same shape as but slightly smaller in size than the isosceles trapezoid at the larger end.

Edges 41, 42, 43 and 44 at the outer end of a cell 30, and edges 45, 46, 47 and 48 at the inner end of the cell, form closed curves of the same shape (in this case an isosceles trapezoid). Corresponding edges are essentially parallel to each other and are transverse to the longitudinal direction of the cell. These edges form the edges of the sidewall means, which as stated earlier, comprise bottom wall 32, top wall 34, and side walls 36 and 38.

Unit cell 30 also has longitudinal edges 49, 50, 51 and 52. These longitudinal edges are at the intersections of adjacent sides. Thus, edge 49 is at the intersection of the respective outside surfaces of bottom wall 32 and side wall 36; edge 50 is at the intersection of the outside surfaces of top 34 and sidewall 36; edge 51 is at the intersection of the outside surfaces of bottom wall 36 and side wall 38 and edge 52 is at the intersection of the outside surfaces of top wall 34 and side wall 38. These longitudinal edges are best seen in FIG. 3. All of these longitudinal edges lie along radii of hemispherical dome 20. These radii intersect at the center O of the dome, (see FIGS. 1 and 2). The two lower longitudinal edges 49 and 51 converge at an angle $\alpha$ (best seen in FIG. 1) going from the larger end ABCD to the smaller end EFGH of the unit cell 30. Similarly, the two upper longitudinal edges 50 and 52 also converge at the angle $\alpha$. The angle $\alpha$, which represents the angle of convergence in the longitudinal direction, is typically from about 0.667° (40 minutes) to about 1°, but may be smaller or larger. The angle between longitudinal edge 49 and a line 54 drawn parallel to the longitudinal axis of the cell 30 (and therefore perpendicular to transverse edge 41) is $\alpha/2$. Similarly, the angle between any longitudinal edge, e.g., 50, 51, or 52 and an intersecting line which is parallel to the longitudinal axis of the cell, is also $\alpha/2$. (Note FIG. 1 in this regard).

The angle of convergence $\beta$ between lower edge 49 and upper edge 50 (also between lower edge 51 and upper edge 52) may be from about 0.33° (20 minutes) to about 0.75° (45 minutes) and is preferably 0.5° (30 minutes). This convergence is shown in FIGS. 1 and 3. When the bottom wall 32 of a cell 30 is horizontal, as is the case in the base or lowermost row of cells, the top wall 34 slopes downwardly at angle $\beta$ from the larger end to the smaller end of the cell.

The slope angle of sides 36 and 38, and therefore of edges 43 and 44, with respect to the verticals 53, shown in FIGS. 3 and 4, is denoted by $\gamma$ (gamma). The value of $\beta$ may vary but is preferably about 30°. The larger the angle $\gamma$, the closer to the top of the dome one can install cells 30. When $\gamma=30°$, it is possible to install cells until there are only six cells in a horizontal row and the sides 36 and 38 of adjacent cells are in touching engagement.

Each unit cell 30 has a transversely extending reinforcing wall 60 with a circular opening. This transverse reinforcing wall 60 is located at the longitudinal center of the cell and extends from the bottom wall 32 to the top wall 34 and from one sidewall 36 to the other sidewall 38. The bottom wall 32, top wall 34 and sidewalls 36 and 38 preferably gradually become thicker going from either end of the cell to the transverse wall 60, so that these sidewalls are at their thickest at the longitudinal center of the cell where they intersect reinforcing wall 60. This may be seen in FIG. 5.

It is possible but not preferred to replace the bottom wall 32, top wall 34 and side walls 36 and 38 with rigid struts which run along the edges 41 through 52. It is also possible but not preferred to replace the sloping sides 36 and 38 with struts at the respective front and back edges (i.e. 43 and 47, and 44 and 48) while providing a bottom wall 32 and a top wall 34. Also, other structures in which portions of the sides 36 and 38 are cut away may be used but are not preferred. Bottom 32 and top 34 should be imperforate as shown, for structural strength of the cell.

Figure 6:
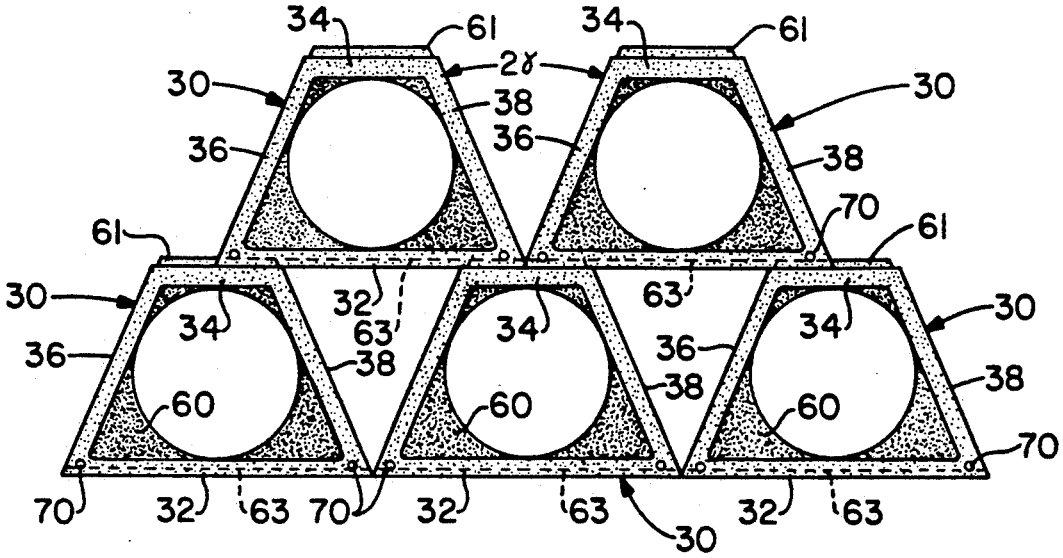
FIG. 6 is a fragmentary front elevational view, on an enlarged scale, of a portion of a hemispherical dome according to this invention.

FIG. 6 shows in elevation an array of cells 30 as it appears from the exterior of the dome 20 near the ground line. In the lowermost or base row of cells, the lower outside edges 49, 51 of each cell are in touching engagement with the lower outside edges of the cell on either side in the same row. When the bottom walls 32 are horizontal, the top walls 34 of the cells in this lowermost row are inclined downwardly at an angle $\beta$ (say 0.5°) going from the outside surface of the sphere to the inside surface. The top walls 34 of the cells in the lowermost row are in abutting relationship with the respective bottom walls 32 of the cells in the second row. Thus the bottom walls 32 in the cells of the second row slope downwardly at an angle $\beta$, going from the outside surface of the dome to the inside, and correspondingly the top walls 34 in the second row slope downwardly at an angle $2\beta$. Similarly, the downward inclination angle of the cells in each row is greater by this angle $\beta$ than the inclination angle of the cells in the row immediately below.

The downward inclination angle $\phi$ of each row of cells is shown in FIG. 2. In FIG. 2, $\phi$ is measured from the horizontal to the bottom surface of a cell; the downward inclination angle of the top surface of that same cell (and of all cells in the same horizontal row) will be $(\phi+\beta)$. Thus the cells become more and more steeply inclined with respect to the horizontal as one goes up the sidewall of the dome, as may be seen in FIG. 2, until the cells 30 in the rows nearest the top are nearly vertical. The angle between sidewalls 36, 38 of adjacent cells in the lowermost row is $2\beta$, as may be seen in FIG. 6. This angle become less and less as one goes up the sidewall, until finally (if rows of cells are installed as close to the top as is theoretically possible) the sidewalls 36, 38 of adjacent cells are in abutting relationship. When $\gamma=30°$, sidewalls are in abutting relationship when there are only six (6) cells in the topmost row.

The cellular structure of dome 20 affords excellent heat insulation, because of the dead air space which this cellular structure affords. Particularly when transparent cells are used, there is a heat collecting greenhouse effect, and very little added heat will be necessary. Indeed, venting (to be described below) around the interior perimeter and at the peak dome is necessary to prevent excess heat build up even in the winter. With a 40° F. outside temperature on a sunny day, interior temperatures of about 90° F. may be expected. Therefore, heat requirements are minimal and heating may be unnecessary in warm and temperate climates. An exterior covering is desirable to prevent ingress of rain water and to shield occupants from wind.

Figure 7:
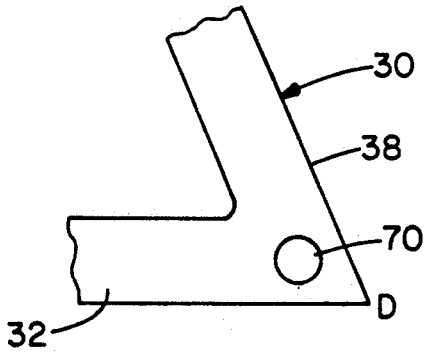
FIG. 7 is a fragmentary elevational view, on a still larger scale than FIG. 6, showing a portion of a unit cell.
Figure 8:
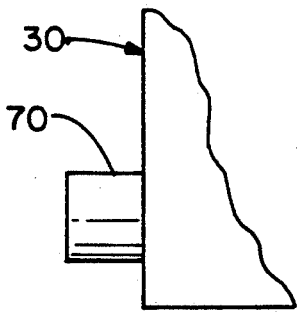
FIG. 8 is a fragmentary side view of the structure shown in FIG. 7.
Figure 9:
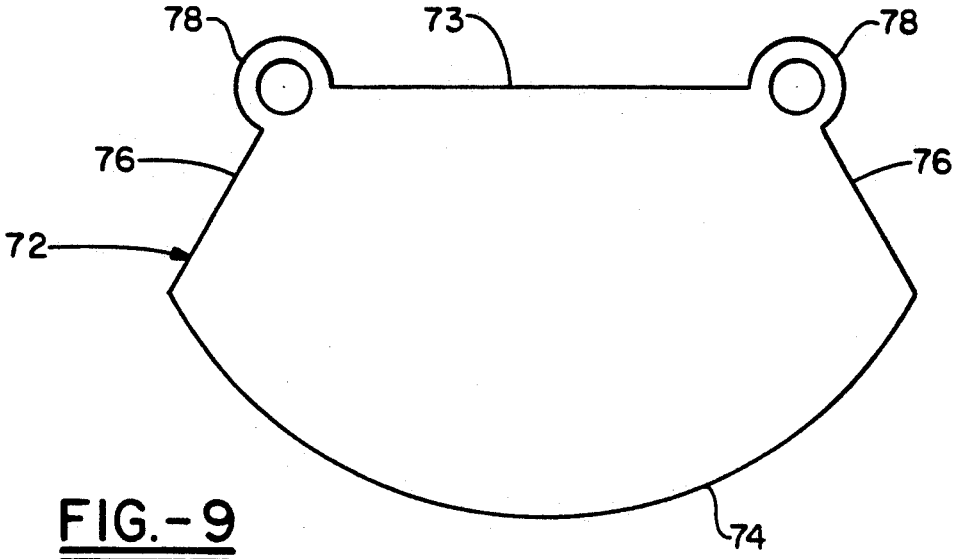
FIG. 9 is a front elevational view of a shingle or panel which is secured to the outside surface of the hemispherical dome as a covering member.
Figure 10:
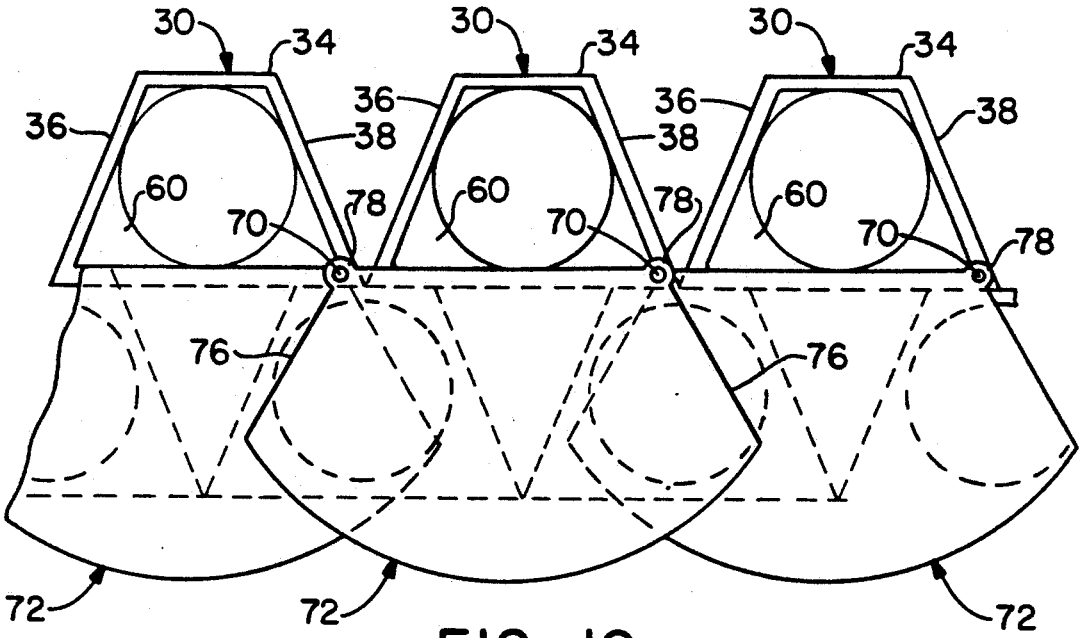
FIG. 10 is a front elevational view showing an array of shingles or panels.

A preferred exterior wall covering, in the form of shingles, will now be described with reference to FIGS. 7–10. Referring now to FIGS. 7 and 8, each cell 30 is provided with outwardly projecting cylindrical studs 70 at the lower outside corners. The preferred shingle 72 may have the shape shown in FIG. 9. The preferred shingle has a straight horizontal upper edge 73, an arcuate lower edge 74, and downwardly and outwardly sloping side edges 76. The shingle is generally fan shaped except that it is truncated at the top so that the two side edges 76 do not intersect. Hangers 78 of generally circular shape are provided at the two upper corners. Each hanger 78 has a round hole to receive the stud 70. These shingles may be either flat (preferred) or arcuate; in the latter case the radius of curvature is essentially the same as that of the outside surface of the dome 20. The shingles are preferably installed so that the top edge of each shingle spans from a corner (say the lower right hand corner) of a cell 30 to the corresponding corner of the next horizontally adjacent cell as shown in FIG. 10. This installation relation arrangement also links horizontally adjacent cells together, although such linkage is not necessary for structural integrity of the dome 20.

These shingles provide an effective means for keeping out rain water and for preventing wind currents from blowing into the dome structure in the event of a high wind.

Other forms of wall covering or "skin" can be used in place of the shingles shown if desired. For example, one may provide thin rigid or semi-rigid sheets of metal or plastic, in which each such sheet member spans over a number of cells. Such plastic or metal sheet members may be adhered to the dome wall in any desired manner. Alternatively, a thin flexible plastic sheet may be provided on either the inside surface or the outside surface of the dome 20. Such sheet would be provided on the inside surface if a slight positive pressure is to be maintained in the interior of the dome, and on the outside surface if a slight negative pressure is to be maintained. Such sheet could be made in a plurality of sections of convenient length and height (for ease of handling) and may be adhered to the inside wall or the outside wall of the dome 20 in any suitable manner.

To prevent longitudinal slippage of a cell 30 during assembly of dome 20, it is preferred to provide a tongue and groove arrangement on the outer end of each cell 30. Such arrangement will be described with reference to FIGS. 11–13. This arrangement also requires a slight modification of the shingle structure shown in FIGS. 9 and 10.

Figure 11:
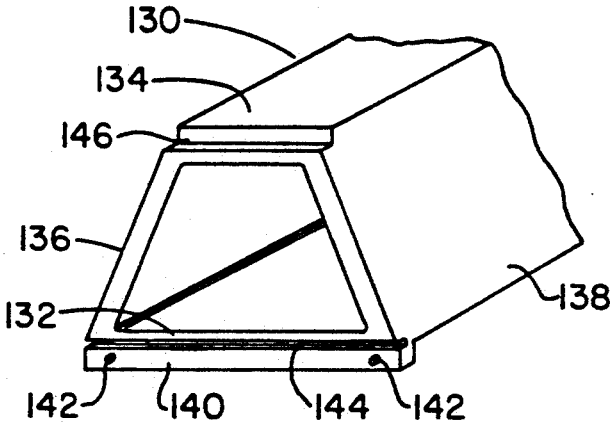
FIG. 11 is a fragmentary perspective view showing the front portion of the unit cell according to a second embodiment of this invention, showing in particular an alternative structure for adjoining vertically adjacent cells together.
Figure 12:
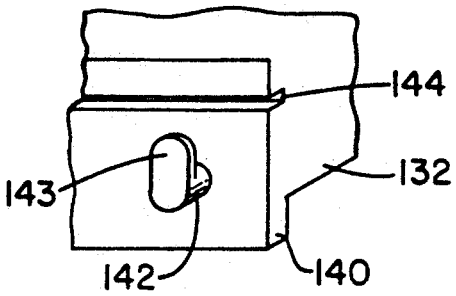
FIG. 12 is a fragmentary side elevational view of the front portion of a unit cell of this invention, including a pin extending therefrom for mounting the shingle.
Figure 13:
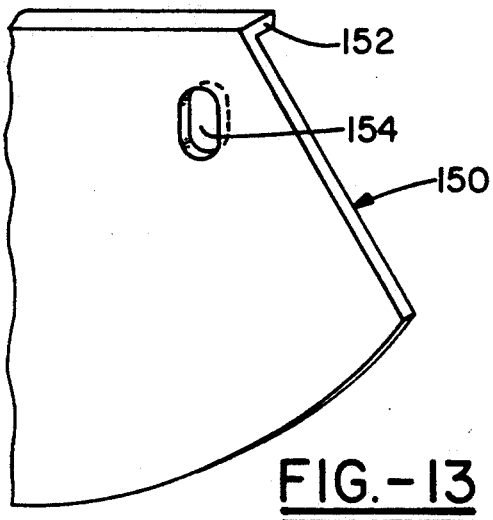
FIG. 13 is a fragmentary perspective view showing a portion of a shingle.

Referring now to FIGS. 11–13, each unit cell 130 according to this alternative embodiment has a bottom wall 132, a top wall 134 and side walls 136 and 138, which are similar to their counterparts 32, 34, 36 and 38, respectively in cell 30 of the first embodiment. A tongue 140 extends downwardly from bottom wall 132 at the front or outer (and larger) end of the cell 130. This tongue may be of rectangular cross-sectional shape as shown. It extends the entire width of the cell 130. Tongue 140 may be either straight or arcuate; in the latter case, the center of curvature is the center 0 of the hemisphere. A pair of studs 142 are provided near either end of the tongue 140 for receiving a shingle. Each stud 142 has a pin 143 extending transversely therethrough near the outer end of the stud. Tongue 140, studs 142 and pins 143 are formed integrally with cell 130 by conventional plastic molding techniques. Just above the tongue 140 is a slotted indentation 144, which extends horizontally over the entire width of the cell, for receiving a lip which may be provided on the shingle as will be described. A horizontally extending cut-out 146 of rectangular cross-section is provided in top wall 134 at the front or outer end of the cell 130 for receiving a tongue 140 of a cell which is placed immediately above the cell shown.

A plurality of shingles 150, which may be generally similar in shape to shingles 72 of the first embodiment, are provided for covering the outer surface of the dome 20. A fragmentary portion of such a shingle 150 is shown in FIG. 13. An inwardly extending flange 152 extends along the entire width of the top edge of shingle 150. This flange 152 is received in recess 144 of the cell 130. Two key holes 154, near either side edge of the shingle 150 just a short distance below the top edge, are provided for receiving studs 142. Each key hole 154 includes a circular opening 156 and a vertically extending slotted opening 158 thereabove. The slotted opening 158 is for the purpose of receiving the pin 143 in stud 142 (see FIG. 12) so as to provide a locking engagement between the shingles and the cells. As in the first embodiment, a shingle may be secured to two horizontally adjacent cells 130,, with a stud 142 near a lower corner (say the lower right hand corner) of one cell being received in one of the key holes 154, and the stud 142 in the corresponding lower corner of the next adjacent cell 130 being received in the other key hole 154 of that shingle.

The modified cell 130 shown in FIGS. 11–13 is preferred because the tongue and groove arrangement, comprising tongue 140 and cut-out 146, prevents a cell 130 from slipping in the radial direction relative to an adjacent cell 130 in the row immediately below during assembly. Prevention of slippage is particularly important at greater heights above base or ground level, where cells are steeply inclined. This tongue and groove arrangement obviates the need for any external support (e.g., along the inside wall surface of dome 20) in order to prevent radial slippage.

The cells may be triangular in cross-sectional shape, wherein the triangle is isosceles (including equilateral). However, the isosceles trapezoidal cross-sectional shape is preferred. The trapezoidal shape affords spaced apart top and bottom wall surfaces wherein the top wall of each cell (except the cells in the top row) affords a support surface for the bottom wall of a cell in the next higher row.

Auxiliaries, such as entranceways, an air intake (or intakes) for outside air (for ventilation purposes), an air vent for returning air to the outside, utility connections and the like, have been omitted since details of these features do not constitute a part of the invention. For example, an air intake may be provided to extend through the wall of dome 20 near ground level, and an air vent may be provided at the top for returning air back to the outside. Suitable joints (including flashing) can be provided by those skilled in the art. Such joints are similar to those used in the building trades for forming joints wherever there is an opening in a sidewall or a roof of a building structure. Interior partitions may be provided according to the needs of the building occupant, if desired, and these also have been omitted. Such partitions are not load bearing.

The cells 30 (or 130) are preferably formed of a rigid, lightweight and yet strong and tough resin. Polycarbonate is the preferred resin. The toughness and high impact resistance of polycarbonate are well known. Other resins, in particular thermoplastic resins, may be used, and may be fiber reinforced in order to achieve desired strength, toughness and impact resistance. Polycarbonate (or other resin when used) may be compounded with suitable fillers and additives such as antioxidants, UV filters, flame retardants, smoke inhibitors and color tints where desired. Suitable formulations and compounding techniques are well known in the art.

The cells 30 (or 130) may be either transparent, translucent or opaque where desirable. Suitable fillers and additives for achieving opacity or translucency in polycarbonate and other inherently transparent resins are known.

An individual cell 30 (or 130) may be formed by conventional molding techniques. Injection molding is preferred.

The dome 20 is erected one horizontal row at a time starting with the first or base row and then placing the cells of each succeeding row on top of the cells of the row immediately below. A conventional self-propelled boom lift work platform can be used. The tongue and groove structures of FIGS. 11–13 are helpful in assuring that each cell is laid in the proper orientation, i.e, with the larger end outward, and in preventing longitudinal sliding or slippage of a cell as it is put in place. Prevention of slippage is particularly important at the higher elevations in the dome, since the cells in each row are more steeply inclined than the cells in the row immediately below, until cells are oriented vertically near the top of the dome, as seen in FIG. 1.

A dome according to this invention is self-supporting, requiring no internal or external support systems. As is true in a semi-circular arch having a keystone, a dome according to this invention is inherently stable and self-supporting. However, a dome according to the present invention does not require any particular structure analogous to a keystone at the top, especially when a tongue and groove arrangement as shown in FIG. 11 is provided. If desired, however, an air vent may be provided at the top and the air vent piping may be surrounded by a frustopyramidal collar having sides whose slope angle is the same as the slope angle of the top surfaces 34 of the highest or last row of cells 30.

As stated before, a dome according to this invention may be built in any convenient size, depending on the needs of the prospective occupant. Dimensions of two representative domes A and B of different sizes will be shown in the table below.

TABLE

| Parameter | A | B |
|---|---|---|
| Diameter of hemisphere, feet and inches (inches) | 229'2" (2750") | 71' (852") |
| Height (radius) of hemisphere, in. | 1375 | 426 |
| Circumference of hemisphere, in. | 8640 | 2676 |
| Number of cells (N) in base row | 480 | 360 |
| Length of cell, in. | 18 | 18 |
| Arcuate width of cell, deg. | 0.75 | 1 |
| Width of cell, in. | | |
| Outer edge | 18 | 7.4375 |
| Inner edge | 17.76 | 7.1232 |
| Arcuate height of cell, deg. | 0.5 | 0.5 |
| Height of cell, in. | | |
| Outer end | 12 | 3.719 |
| Inner end | 11.84 | 3.562 |

Once the desired dome diameter and wall thickness and the desired width and height of a cell are decided on, all other dimensions can be calculated by those skilled in the art using well known solid geometry equations. Thus:

The relationship between the outside diameter D, the outside radius R and the circumference C of a dome according to the present invention are given by the well known equations (1a) and (1b) below. The overall height of a dome 20 according tot his invention is substantially equal to the outside radius R (neglecting any structures provided on an exit vent pipe which extends through the dome wall along the vertical axis thereof).

$$D=2R \quad (1a)$$

$$C=\pi D=2\pi R \quad (1b)$$

The number N of cells 30 around the circumference of the dome in the lowermost or base row (at the base line or "equator") is given by equation (2) below.

$$N\alpha=360^\circ \text{ or } N=360^\circ/\alpha \quad (2)$$

In equation (2) above, a is as defined previously in the specification, and is the angular width of a single unit cell 30.

The length of a unit cell 30 or 130 of this invention is equal to the wall thickness of the dome 20, and each of these quantities is equal to the difference between the outside radius R and the inside radius of the dome 20.

The relationship between the linear width W of a cell 30 at its larger or outer end, and the outside radius R and the angular width a of the cell can be calculated according to well-known geometric equations. Similarly, the relationship between the linear height H of a cell 30 at its larger end, the outer radius R of the hemisphere or dome 20 and the angular height $\beta$ can be calculated according to well-known geometric equations.

The dome 20 of this invention has been described herein as hemispherical. More broadly, a dome according to this invention may be described as being generally spherical in curvature, since it may constitute either somewhat more or somewhat less than a hemisphere. Also, both the outer ends and the inner ends of a cell 30 or 130 are typically planar rather than spherically curved so that the outer surface of the dome is generally spherical rather than being spherical in the strictest sense. Actually, the outside corners A, B, C and D of every cell do lie in a common spherical surface. While a dome according to this invention may constitute either slightly more or slightly less than a hemisphere, the hemisphere is preferred for maximum structural stability and because a hemisphere affords greater area at ground level than would a dome which constitutes more than one-half of a sphere.

A dome according to the present invention possesses several advantages not possessed by other domes of generally spherical configuration, as well as some additional advantages which are not possessed by conventional building structures having vertical walls.

First, a dome according to this invention utilizes unit cells or building blocks of a single size and shape. This is not true of other domed structures.

Second, a dome according to this invention can be built from the ground up.

Third, a dome according to this invention is self supporting. No internal columns or framework are required for support.

Fourth, lightweight construction materials, notably plastics can be used, and a dome according to this invention is several times lighter in weight than a conventional building structure having vertical walls, but with approximately the same ground area and cubic volume as a dome herein, would be.

Fifth, a dome according to this invention stores heat efficiently so that little if any heat is required, or at least (e.g. in severe climates during the winter) heating requirements are greatly lessened. At the same time, a dome according to this invention lends itself to efficient air circulation so that summer air conditioning requirements are not excessive.

While this invention has been described with respect to specific embodiments including the best mode and preferred embodiment thereof, it shall be understood that such description is by way of illustration and not limitation.

What is claimed is:

1. A hemispherical dome building structure comprising:

(a) a plurality of like oriented rigid unit cells having the same size and shape, said cells defining an essentially hemispherical open rigid building structure having an essentially hemispherical outside surface and an essentially hemispherical inside surface concentric with and spaced from said outside surface;

(b) each of said cells having an open interior affording a dead air space, each of said cells being of essentially frustopyramidal shape and having a longitudinal direction which is aligned with a radial direction of the hemispherical building structure, each cell having first and second ends which are spaced apart and a plurality of longitudinal edges extending from said first end to said second end, said first end being larger than said second end, said longitudinal edges tapering inwardly along radii of said building structure;

(c) each of said cells having the cross-sectional shape of an isosceles trapezoid, the cross sectional shape of each cell being substantially the same over its entire length and decreasing gradually from said first end to said second end;

(d) each cell extending from said outside surface to said inside surface of said building structure;

(e) each unit cell being oriented so that its first end lies along said outside surface of said building structure and its second end lies along said inside surface of said building structure, the larger ends of the unit cells forming said outside surface of said building structure and the smaller ends of the unit cells forming said inside surface of said building structure.

2. A dome according to claim 1 wherein each said cell has side wall means comprising a plurality of sides extending around a perimeter of said cell and extending from said first end to said second end, and wherein adjacent sides intersect along said longitudinal edges.

3. A structure according to claim 2 wherein each said side wall means include a bottom wall, a top wall and a pair of opposed sloping side walls extending from said first end to said second end, said top wall being appreciably narrower than said bottom wall, said side walls sloping upwardly and inwardly from said bottom wall to said top wall and having a slope angle of about 30° with respect to line perpendicular to said lower edges.

4. A structure according to claim 1 wherein said each cell has a first edge at said first end and a second edge at said second end, said first and second edges being closed curves of the same shape and being essentially parallel to each other and transverse tot he longitudinal direction of the cell.

5. A dome according to claim 1 wherein each said cell is open at both ends.

6. The dome according to claim 1 wherein the cells are formed of an essentially rigid plastic material.

7. The dome according to claim 6 wherein said plastic material is polycarbonate containing compounding ingredients.

8. A structure according to claim 1 wherein said cells are arranged one above the other and in side by side relationship.

9. A structure according to claim 1 wherein said longitudinal edges comprise a pair of lower longitudinal edges and a pair of upper longitudinal edges, said upper longitudinal edges being substantially closer together than said lower longitudinal edges.

10. A structure according to claim 9 wherein said cells are arranged in horizontal rows and wherein the lower longitudinal edges of adjacent cells are in substantially touching relationship.

11. A structure according to claim 1 in which each cell has a transverse reinforcing member.

12. A structure according to claim 1 further including shingles secured to said cells at the first ends thereof, said shingles providing an exterior wall covering for said structure.

* * * * *